US008044819B1

(12) United States Patent
Bessiere et al.

(10) Patent No.: US 8,044,819 B1
(45) Date of Patent: Oct. 25, 2011

(54) COAL BOUNDARY DETECTION USING AN ELECTRIC-FIELD BOREHOLE TELEMETRY APPARATUS

(75) Inventors: Pierre C. Bessiere, Houston, TX (US); James C. Liu, The Woodlands, TX (US); Matthew A. White, Templeton, CA (US)

(73) Assignee: Scientific Drilling International, Houston, TX (US)

( * ) Notice: Subject to any disclaimer, the term of this patent is extended or adjusted under 35 U.S.C. 154(b) by 1060 days.

(21) Appl. No.: 11/584,778

(22) Filed: Oct. 23, 2006

(51) Int. Cl.
*G01V 3/00* (2006.01)

(52) U.S. Cl. ..... 340/853.3; 340/853.4; 340/853.6

(58) Field of Classification Search ..... 324/366; 175/45, 50; 340/853.3, 853.4, 853.6
See application file for complete search history.

(56) References Cited

U.S. PATENT DOCUMENTS 5,130,706 A 7/1992 Van Steenwyk
5,883,516 A 3/1999 Van Steenwyk et al.
6,153,155 A 11/2000 Wen et al.
6,188,223 B1 2/2001 Van Steenwyk et al.
6,280,000 B1 8/2001 Zupanick
6,396,276 B1 * 5/2002 Van Steenwyk et al. ..... 324/366
6,425,448 B1 7/2002 Zupanick et al.
6,466,020 B2 * 10/2002 Kuckes et al. ..... 324/326

* cited by examiner

*Primary Examiner* — Brian Zimmerman
*Assistant Examiner* — Hung Dang
(74) *Attorney, Agent, or Firm* — William W. Haefliger

(57) ABSTRACT

A method to detect the relative position of a drill bit with respect to a coal seam boundary using an electric-field borehole telemetry apparatus, that includes the steps: providing a measure-while-drilling apparatus that includes inclination sensors, directional sensors, logging sensors of choice and an electric-field borehole telemetry apparatus, within the electric-field borehole telemetry apparatus, in addition to monitoring the inclination, direction and logging parameters, monitoring one or more parameters of the electrical output of the telemetry apparatus, transmitting to the surface the inclination, direction and logging parameters as well as the one or more parameters of the electrical output by means of the telemetry apparatus, computing the usual drilling parameters needed to guide the drill string along the intended path, determining from the one or more transmitted parameters of the electrical output from the downhole apparatus parameters indicative of approaching or penetrating the coal boundary, and making corrections to the direction of drilling to maintain the drill string and bit in the coal seam.

11 Claims, 5 Drawing Sheets

1
5a
5
5b
5c
4
6a
6b
2
6c
3
6d
10b
10a
8a
+V
-V
7
7a
8
9
6f
6e

COAL BOUNDARY DETECTION USING AN ELECTRIC-FIELD BOREHOLE TELEMETRY APPARATUS

BACKGROUND OF THE INVENTION

This invention relates generally to coal formation detection and more specifically to coal layer boundary detection using borehole telemetry apparatus. It is well known that coal in natural formations may contain significant amounts of methane, a natural gas. It is further well known that coal is usually found in nominally horizontal beds and that economically significant amounts of methane can be recovered by boring holes into the coal bed. Such bored holes are nominally horizontal and the coal beds are relatively thin in vertical extent. U.S. Pat. Nos. 6,280,000 and 6,425,448 describe examples of such drilling and show particular patterns of holes to drain methane from the coal formation. In the boring of such holes, some means is needed to steer the drilling progress so as to remain in the coal bed and, to the extent possible, bore a straight hole such that up and down variations in the borehole path are minimized.

Conventional or current boring, or drilling, operations use some sort of measure-while-drilling (MWD) apparatus. Such an apparatus generally includes inclination and direction sensors, various logging sensors to assist in determining that the borehole trajectory remains in the coal seam and a communication means to transmit data to the surface so that the necessary control operations to control the drill string path can be performed. Typical inclination sensors include accelerometers to sense the earth's gravity field. The most commonly used direction sensors are magnetometers to sense the earth's magnetic field although gyroscopic sensors may be used in some circumstances. Logging sensors may include conventional resistivity sensors based in the low-megahertz frequency range, total gamma ray sensors and focused gamma ray sensors. In current practice, the only sensors that can provide reliable information on whether or not the drilling apparatus is within or out of the coal seam in surrounding rock formation are the various gamma ray sensors. Theses sensors generally have a very short range, perhaps only a few inches, and thus the drill bit may already be out of the coal seam by the time that gamma ray sensors provide an indication of such a condition. Given this limitation, such boreholes may have considerable variation in inclination as the path of the drill bit is steered to remain in the coal seam. Further, conventional resistivity tools would increase the length of the bottom hole assembly at the bottom of the drill string and would increase the cost of drilling. While certain resistivity apparatus and methods are used to steer the drilling apparatus in order to maintain the borehole in a desired geological bed, none of these is similar to or has the advantages of the present invention described below.

There is a need for sensing means that can efficiently detect the boundary of the coal seam, at a considerably greater depth of investigation around the borehole and most desirably one that can provide some indication of the conditions out ahead of the bit so as to permit correction of the drill path with reduced variation in inclination. It is well known that the resistivity of the coal in a coal seam may lie in the range of 50 to 100 ohm-meters and the resistivity of the adjacent rock, above or below the coal seam may lie in a range 1 to 4 ohm-meters.

In the measure-while drilling (MWD) process for drilling into coal seams, the borehole telemetry technique of choice is the electric field technique that involves direct injection of electric current into the surrounding formation at a point below an insulating gap in the generally conducting steel drill string. This injected current flows out into the formation and develops a detectable electric voltage between a remote contact to the earth and the drill string at the surface of the earth. Examples of such apparatus are disclosed in U.S. Pat. Nos. 5,130,706, 5,883,516, 6,188,223 and 6,396,276. It has been observed experimentally, and confirmed analytically, that when the drill bit is in a coal seam the apparent driving-point impedance, defined as the ratio of the output voltage to the output current, seen at the output stage of an electric field borehole telemetry apparatus decreases as the drill bit below an insulating gap approaches the coal seam boundary and penetrates into an adjacent rock layer. Further, it has been observed experimentally and confirmed analytically that the received signal strength at the surface of the earth increases for the same approach to and penetration into an adjacent rock layer.

SUMMARY OF THE INVENTION

It is a major objective of this invention to use the referenced and confirmed variations in an improved method to detect a coal boundary using an electric field borehole telemetry apparatus. This method enables use of the telemetry apparatus to transmit inclination, direction and logging parameter to the surface for use in steering the drill string to remain in the coal seam, in a way that substantially benefits results in terms of better control of the borehole trajectory at a lower cost. The invention provides a method for assisting in steering a drill bit so as to maintain the drill bit in a coal seem. The method of the invention includes detecting the relative position of the drill bit with respect to a coal boundary, using an electric-field borehole telemetry apparatus.

Another object is to provide a method of maintaining drill bit advancement in an underground in situ coal seam at a level offset from underground formation, that include a) passing an electrical signal from a location in the vicinity of the bit to a location in the underground formation, above the level of the bit, b) detecting substantial change in said signal as the bit advances, c) and changing the direction of drilling of the bit as a function of said signal change, to thereby maintain the direction of bit advancement in the coal seam.

In this regard, the electrical signal is typically electrical current passed from the coal seam through a coal seam boundary into the underground formation.

More detailed steps of the method include:

1. providing a measure-while-drilling apparatus that includes inclination sensors, directional sensors, logging sensors of choice and an electric-field telemetry borehole telemetry apparatus, 2. within the electric-field telemetry borehole telemetry apparatus, in addition to monitoring the inclination, direction and logging parameters monitoring parameters of the electrical output of the telemetry apparatus such as pulse voltages, pulse currents and/or pulse power, 3. transmitting to the earth's surface the inclination, direction and logging parameters as well as the parameters of the electrical output by means of the telemetry apparatus, 4. detecting at the surface the data transmitted and monitoring the signal strength received at the surface, 5. computing the usual drilling parameters needed to guide the drill string along the intended path, 6. determining from the transmitted parameters of the electrical output from the downhole apparatus and the signal strength received at the surface, parameters indicative of drill bit approaching or penetrating the coal boundary, and 7. making corrections to the direction of drilling to maintain the drill string and bit in the coal seam.

DRAWING DESCRIPTION

FIG. 1 shows a typical coal seam drilling process including a drill string, an insulating gap near the bit and various layers of material in the region of a coal seam;

FIG. 2*a* shows a computer simulation of the output current of the electric-field telemetry apparatus when the drill bit and drill string are in the coal seam and not in contact with other layers of the formation;

FIG. 2*b* shows a computer simulation of the output current of the electric-field telemetry apparatus when the drill bit in contact with another layer of the formation above the coal seam;

DETAILED DESCRIPTION

Figure 1:
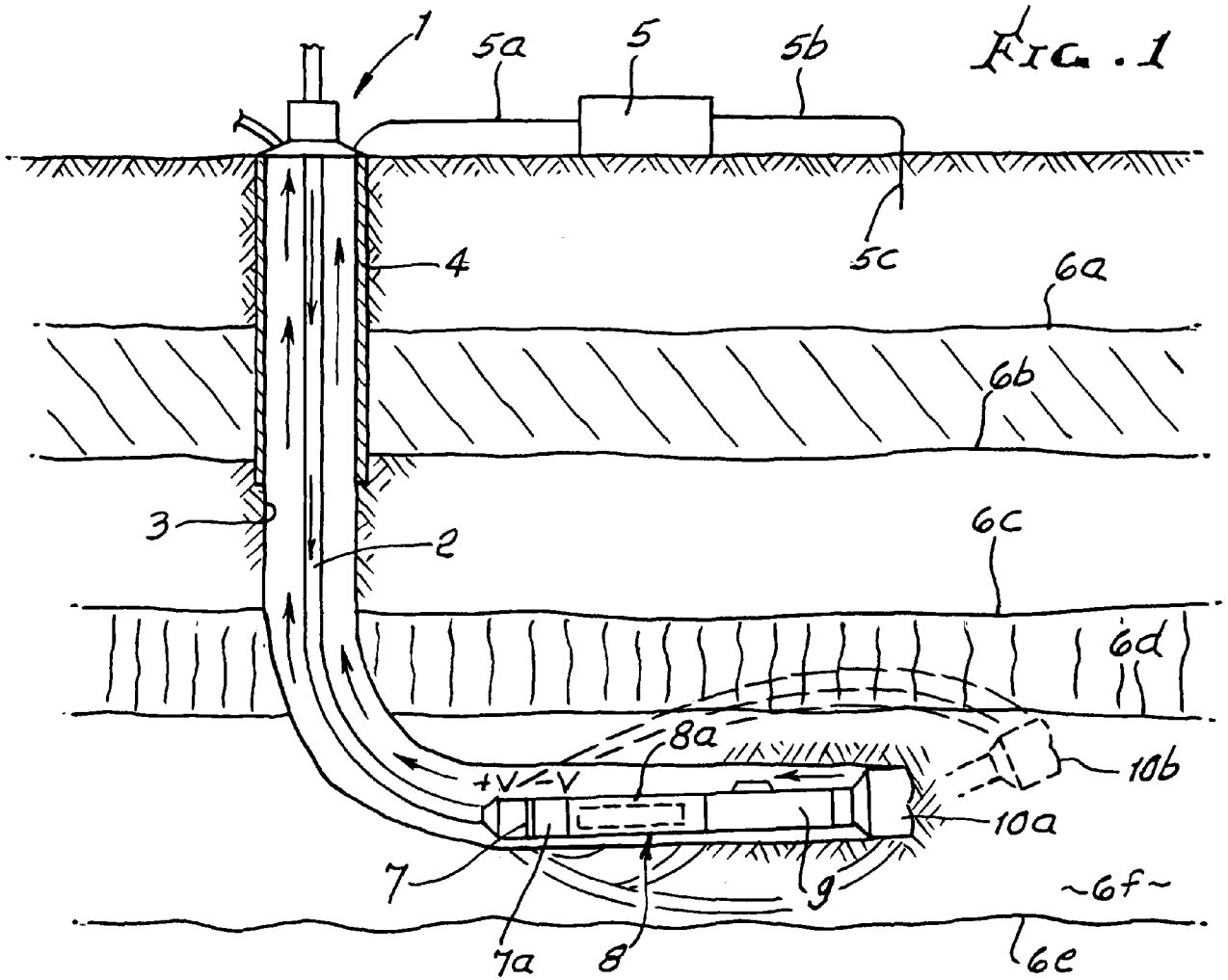

FIG. 1 shows a typical coal seam drilling process including a drill string, an insulating gap near the bit and various layers of material in the region of a coal seam. A drill rig 1 at the surface of the earth is connected to a drill string 2 penetrating down into the earth. The upper portion of the borehole is shown with casing 4 and the open hole 3 continues below the casing. An insulating gap 7 in the string is at the lower end of the drill string. Below the insulating gap a non-magnetic collar 8 in the string contains a measure-while-drilling (MWD) apparatus indicated at 8*a*. A mud motor 9, below 8, is used to rotatably operate a drill bit 10*a*. A future projection of the location of the drill bit indicated at 10*b* shows where the drill bit is projected to be at some future time. At the surface, an electronics assembly 5 is shown electrically connected to the upper end of the drill string, as by connection 5*a*. Connection 5*b* provides an electrical connection from a remote contact 5*c* with the earth to the electronics assembly 5. Information is communicated from the measure-while-drilling apparatus to the electronics assembly 5 by applying output voltage or current signals across the insulating gap 7, as by means 7*a* (see plus and minus voltage zones +v and −v. Current then flows from the lower region below the insulating gap 7 through the earth to the surface. This current then causes a voltage difference between the upper end of the drill string connected to lead 5*a* and the remote connection to the earth connected to lead 5*b*. The drill string between the insulating gap 7 and the upper end of the drill string connected to lead 5*a* is generally of steel and therefore has much greater conductivity than the path through the earth.

The earth formation going downward from the surface is indicated typically by layer boundaries 6*a*, 6*b*, 6*c*, 6*d* and 6*e*. These boundaries will, in general, represent different kinds of rock, and the region between the boundaries 6*d* and 6*e* are the upper and lower boundaries of a coal seam or layer 6*f* that is to be drilled. The location of this coal seam is generally known as by prior work before drilling is begun. By well known techniques, such as using a mud motor and a bent sub in the string above the bit, the borehole 3 is drilled downward from the surface and then caused to turn toward a horizontal condition as shown when the depth of the coal seam is reached. The coal seam is most often nominally horizontal, but there may be a known or approximately known small inclination angle to the seam. The object of the drilling process is to drill for an extended distance while maintaining such drilling within the coal seam to provide a path for the recovery of methane gas from the coal seam. Previously, little information was available to assist in maintaining the drill bit path within the coal seam. Gamma ray detectors, either total gamma ray counters or so-called focused gamma ray counters, were frequently used for detecting an out-of-coal drilling condition. Such detectors provide very short depth of investigation and are located a considerable distance behind the bit so that the resulting borehole path tended to have considerable up and down bending deviation since the bit had to be out, or nearly out, of the coal bed or layer before deviation from the desired trajectory was sensed, and only then could a correction in drilling direction be made, using known measure-while-drilling techniques to change the inclination of the borehole to return to the desired trajectory.

During employment of an electric-field borehole telemetry apparatus, and a part of the measure-while-drilling apparatus, that included monitoring and transmitting the value of the output current along with the other data, it was observed that when the bit was approaching or deviating out of the coal seam, the output current increased. It was further noted that under such conditions, the signal level received at 5 at the surface between connections 5*a* and 5*b* increased. It was also observed that the resistivity of the coal in the coal seam was significantly higher than the resistivity in the adjacent rock layers such resistivity affecting the output current. Typical resistivity for a coal seam may be on the order of 100 ohms-meter while that of adjacent rock layers such as shale may be on the order of 4 ohm-meters.

Figure 2A:
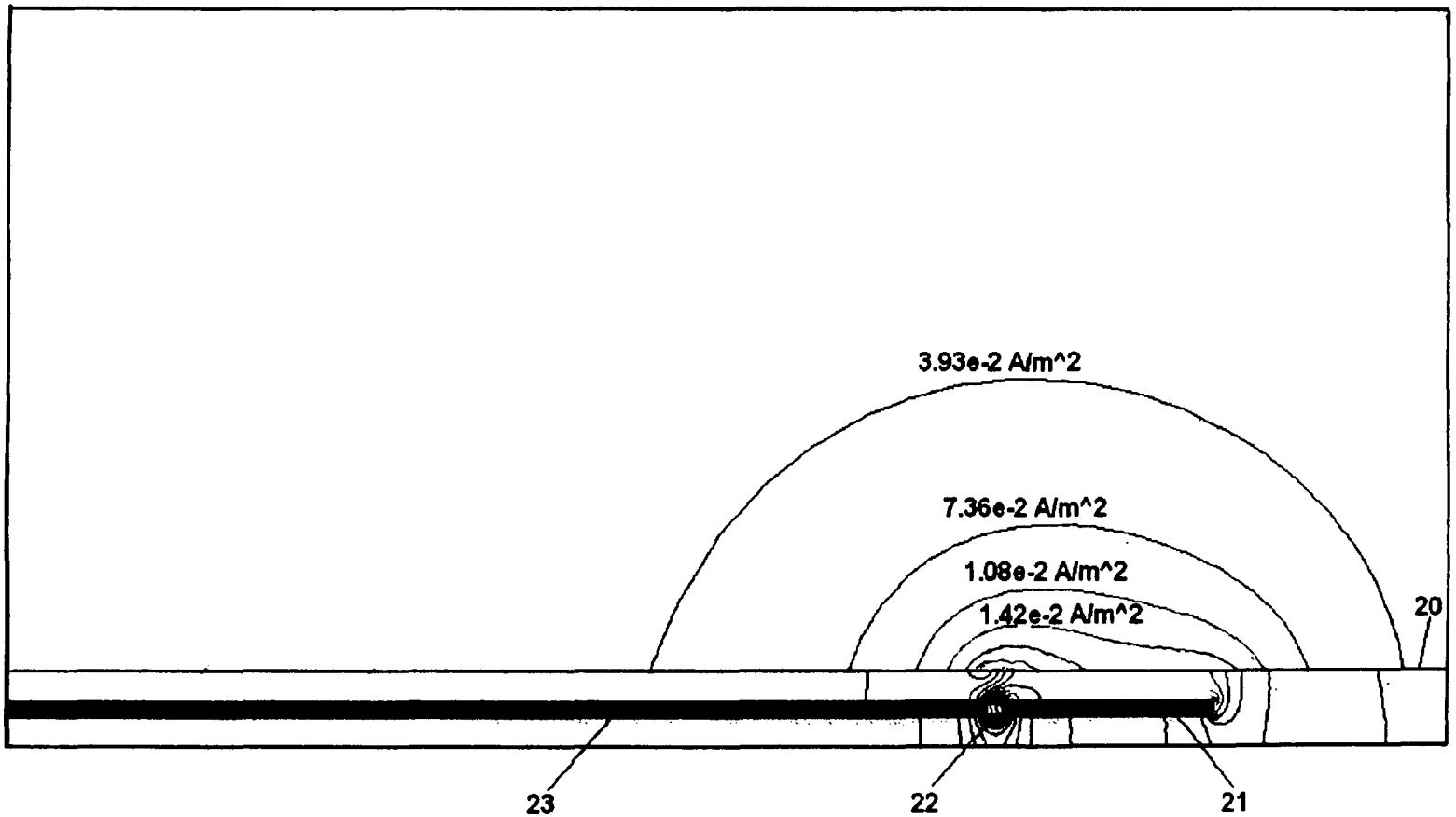

FIG. 2*a* shows a computer simulation of the output current of the electric-field telemetry apparatus when the drill bit and drill string below gap 7 are in the coal seam and not in contact with or penetrating into other layers of the formation. This can be represented by using an electrical finite element model. The region of the formation above the upper boundary 20 of the coal has a resistivity of 4 ohm-meter. The region in the coal below the coal boundary 20 has a resistivity of 100 ohm-meter. The contour lines in the diagram are such that they show electric current density. The current density contours are labeled in terms of amperes per square meter (A/m^2). An insulating gap 22 is provided between the portion of the drill string 23 above (i.e. to the left of) the insulating gap and that portion of the drill string, including the drill bit, 21 below (i.e. to the right of) the insulating gap 22. Neither the drill bit nor any portion of the drill string as referred to is in contact with the low-resistivity material above the coal boundary 20. The contour lines going from $1.42e^{-2}$ A/m^2 near the drill string section 21 to 3.93e A/m^2 at longer distances from 21 are indicative of low current density resulting from the high resistivity of the coal between the drill string and the layer above the boundary 20.

Figure 2B:
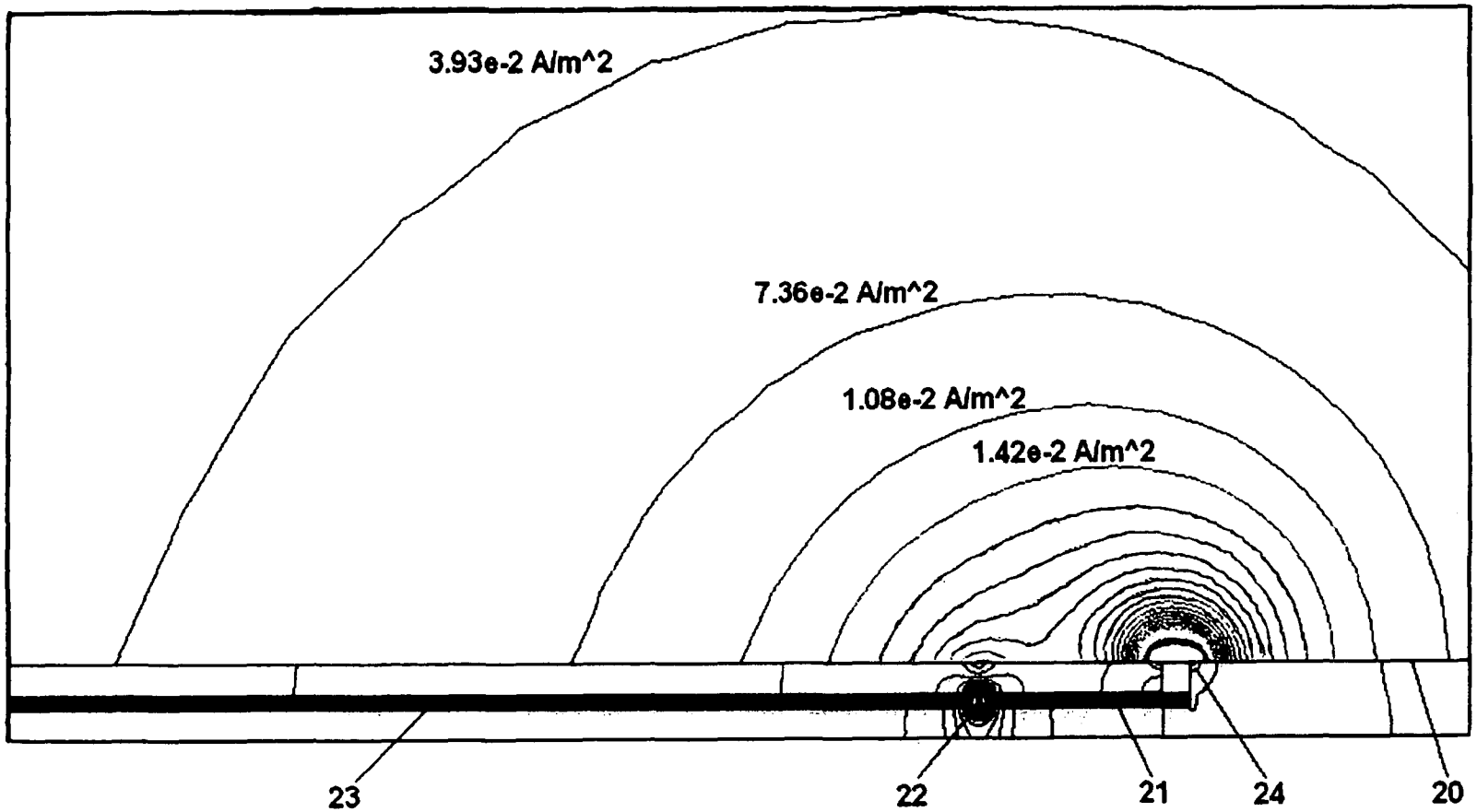

FIG. 2*b* shows a computer simulation of the output current of the electric-field telemetry apparatus when the drill bit is in contact with another layer of the formation. The same electrical finite element model was used as for FIG. 2*a*. The resistivities of the layers are the same as for FIG. 2*a*. In FIG. 2*b* the drill bit 24 is just in contact with the layer above the edge of the coal 20. From the much greater distances to the corresponding current density contours of FIG. 2*a*, in this figure above the seam edge 20, it is apparent that the current density is much larger in this region than it was for the case of FIG. 2*a* where there was no contact. The driving voltage applied between the drill string sections 21 and 23, across the insulating gap 22, was the same for both computations. The region above the coal boundary and extending to the surface can be considered as an impedance network. Since the current flowing into the network is increased, the so-called driving point impedance seen by the power-output device in the electric-field borehole telemetry apparatus is decreased for FIG. 2*b* in comparison to FIG. 2*a*. Driving point impedance for a network is defined as the applied voltage divided by the input current. Such a driving point impedance is generally abbreviated as $Z_D$. This confirms the experimental observation that the driving point impedance seen by the telemetry apparatus decreased when the bit was known to be approaching or out of the coal seam. Further, since the current flowing into the layers above the bit is increased for the conditions of FIG. 2*b* the voltage received at the surface between the leads identified as 5*a* and 5*b* in FIG. 1 will be increased. The value of $Z_D$ can be determined from measurements transmitted from the downhole location to the surface and the voltage received at the surface can be measured. Thus there are two measures available from the telemetry apparatus that provide useful information on the positional relation of the drill bit and the boundary of the coal seam. In other drilling situations not related to coal bed methane recovery changes in the voltage received at the surface using an electric-field borehole telemetry apparatus have been noted and believed to be related to formation resistivity.

Figure 3:
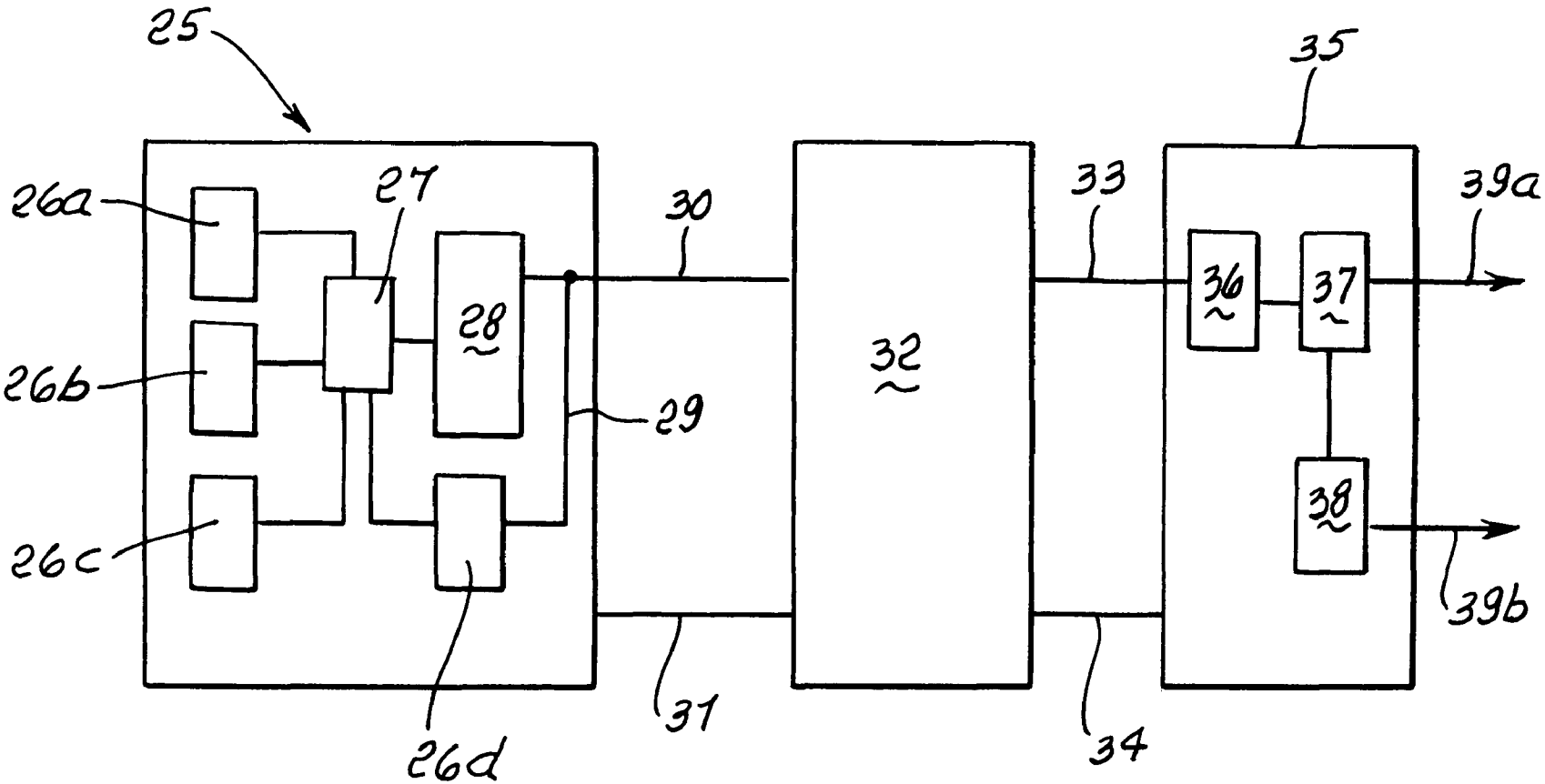
FIG. 3 Is a block diagram showing the borehole telemetry apparatus, the conductive media between the down-hole and up-hole regions and the receiving and processing apparatus at the surface.

FIG. 3 shows a block diagram representative of the borehole telemetry apparatus, the conductive media between the down-hole and up-hole regions and the receiving and processing apparatus at the surface. An electric field borehole telemetry apparatus 25 comprises inclination sensors 26*a*, direction sensors 26*b*, and logging sensors 26*c* connected to a signal conditioning, multiplexing and coding section 27. The output of the coding section 27 is applied to a power section 28 that is connected to the output line 30 which is connected to the drill bit below the insulating gap 7 of FIG. 1. The power section 28 may be of a constant voltage, constant current or other type. Connection 29 transmits information, for example voltage and/or output current, from the outputs line 30 to monitoring elements 26*d*. The output of the monitoring elements 26*d* is connected to the coding section 27 so the results of such monitoring are added into the data stream that is transmitted to the surface. Output line 31 is a current return path and represents elements of the conductive drill string above insulating gap 7 of FIG. 1.

The block 32 represents the conductive media between the down-hole and up-hole regions. As shown it is a typical four-terminal electric network. The terminal connected to lead 31 is the point on the drill string just above the insulating gap 7 of FIG. 1 and the terminal connected to lead 34 is the point at the top of the drill string connected to lead 5*a* of FIG. 1. If the resistivity of the drill string between the insulating gap and the surface is insignificant compared to all other resisitvities, the points of connections 31 and 34 may be considered common and the network reduces to a three-terminal network. The lead 33 is equivalent to lead 5*b* of FIG. 1 and represents the connection from a remote contact with the surface of the earth and the receiving and processing apparatus at the surface 35. The receiving and processing apparatus 36 provides amplification, de-multiplexing and decoding of the received signal to recover the data transmitted from the downhole location and a measure of the amplitude of the received signal. The block 37 provides any further decoding and data conversion required and provides inclination, direction and logging outputs on lead 39*a* to operators to assist in judging the path of the borehole and planning any needed corrective actions, as for bit steering. Downhole electrical output information, for example voltage and/or output current, as well as a measure of the amplitude of the received signal are transmitted to block 38 as parameters indicative of approaching or penetrating the coal boundary for evaluation of the relationship of the borehole location to the desired in-coal location. Information from this evaluation is transmitted to operators on lead 39*b* for planning any required actions to remain in the coal seam.

Some electric-field borehole telemetry apparatus may include a capability to transmit command information downward from the surface to the downhole telemetry apparatus. When such a capability is present and evaluation parameters indicate a possible approach to the coal seam boundary a command may be sent downward from the surface directing the downhole apparatus to increase its output signal power. This may be done by increasing the voltage, current or time duration of the signals being transmitted upward. With such an increase in the transmitted signal uncertainties such as downhole movements, rig noise and surface interference are minimized, thus in effect increasing the signal-to-noise ratio of the boundary detection process.

Note that the only apparatus that needs to be added to the electric-field borehole telemetry apparatus as shown in FIG. 3 to permit the use of the method of this invention includes the block 26*d*, the monitoring elements, and block 38, the block that provides the evaluation of the relationship of the borehole location to the desired in-coal location.

Figure 4:
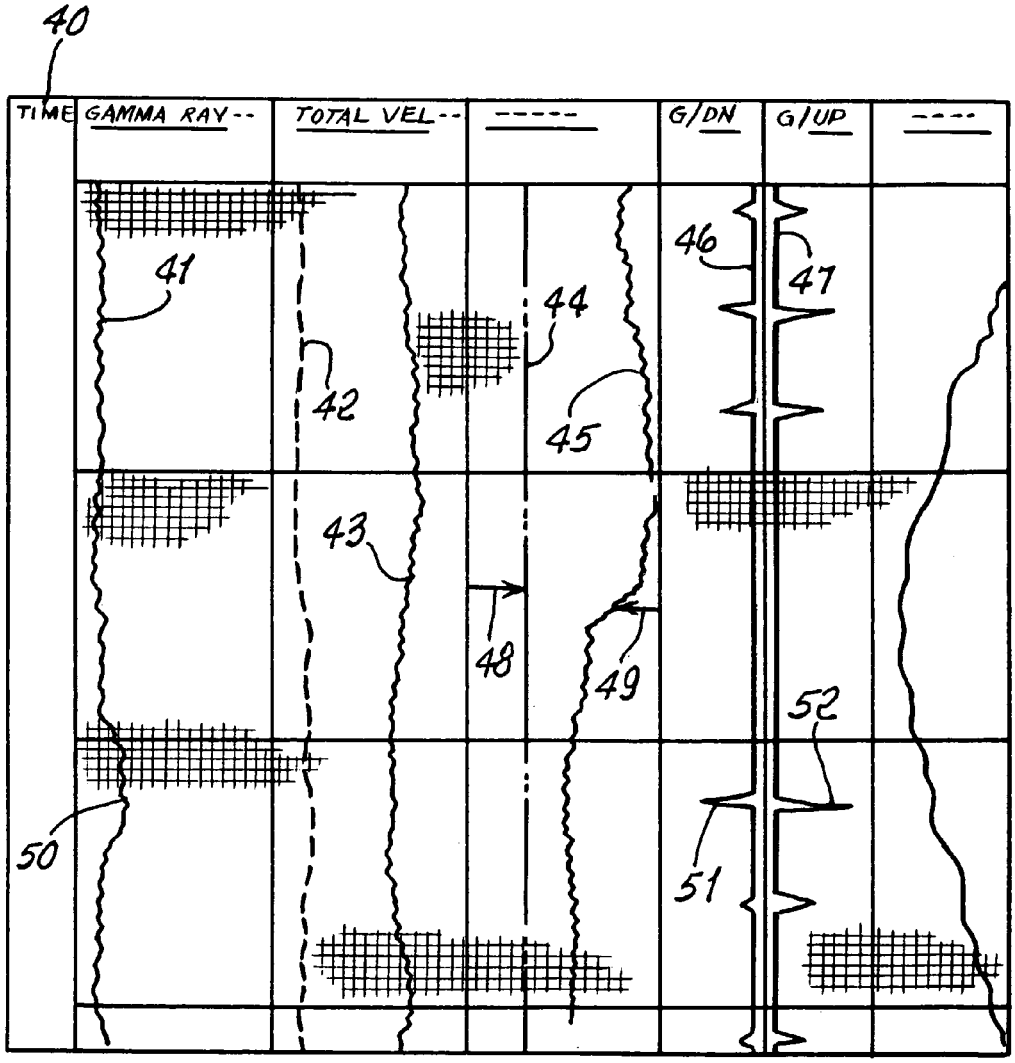
FIG. 4 shows a detail log plot from an actual drilling operation in a coal seam and shows the transmission-parameter variations that are indicative of approaching or penetrating the coal boundary.

FIG. 4 shows a detail log plot from an actual drilling operation in a coal seam, and indicates the transmission-parameter variations that are indicative of approaching or penetrating the coal boundary. A date/time scale 40 is shown at the left of the figure. The major divisions on this scale are one hour, the next level of scale is ten minutes and the finest scale is for two-minute time increments. A trace 41 for the output of a gamma ray detector, a trace 42 for the tool output current, a trace 43 for the tool output voltage, a trace 44 for the received signal at the surface of the earth, a trace 45 for the driving point impedance, $Z_D$, (defined as the ratio of the tool output voltage to the tool output current), and two traces 46 and 47 for a focused gamma ray measurement are provided. Trace 46 is for gamma ray data received from the down direction and trace 47 if for gamma ray data received from the up direction. Other traces are shown for ROP, rate of penetration, TVD, total vertical depth and Bit Depth but these are not used in the discussion below. Note that near point 48 an increase in Pulse Voltage, the received signal at the surface, shown on trace 44 is seen. Further, near point 49 a decrease in the driving point impedance shown on trace 45 is seen. These changes are indicative that the tool bit is approaching the boundary between the coal seam and the adjacent lower-resistivity rock layer. Drilling proceeded for about twenty minutes before an increase in the gamma ray measurement shown on trace 41 is observed. This increase that becomes a maximum near the point 50 in the total gamma ray measurement and indicates that the drilling apparatus is proceeding or deviating out of the coal seam. Further, the focused gamma ray signals, shown on traces 46 and 47 confirm that the tool is out of the coal as shown by points 51 and 52. Since the amplitude of the gamma-up signal 52 is greater than the gamma-down signal 51, it is apparent that the tool has gone out of the coal seam at the top of the seam. Corrective action was taken and the tool descended back into the coal, restoring the indicated signal to levels comparable to those seen before the detection of indications that the drill trajectory was going toward an out-of-coal condition.

The significant issue is that the indications from trace 44, the surface received signal, and trace 45, the driving point impedance, showed the existence of the problem about 20 minutes prior to actually going out of the coal. Corrective action based on these indications can prevent going out of the coal and this would result in a smoother borehole trajectory in the seam.

It is clear from the discussions above that the indications of approach to and going beyond (i.e. penetrating) the boundary of the coal bed are similar at both the upper and lower boundaries of the bed. Operator experience and the making of minor variations in the inclination of the borehole to observe changes in the indications provide the means to identify which case is most probable.

We claim:

1. A method to detect the relative position of a drill bit with respect to a coal seam boundary using an electric-field borehole telemetry apparatus, that includes the steps:

a) providing a measure-while-drilling apparatus that includes inclination sensors, directional sensors, logging sensors of choice and an electric-field borehole telemetry apparatus, b) within the electric-field borehole telemetry apparatus, in addition to monitoring the inclination, direction and logging parameters, monitoring one or more parameters of the electrical output of the telemetry apparatus, c) transmitting to the surface the inclination, direction and logging parameters as well as the one or more parameters of the said electrical output by means of the telemetry apparatus, d) computing the usual drilling parameters needed to guide the drill string along the intended path, e) determining from the one or more transmitted parameters of the electrical output from the said downhole apparatus parameters indicative of approaching or penetrating the coal boundary, and f) making corrections to the direction of drilling to maintain the drill string and bit in the coal seam, g) the method including:

i) providing an insulating gap in lower end extent of the drill string, directly behind the drill bit, thereby to maneuver the gap to travel closely and in alignment with the bit in the coal seam, ii) applying output voltage derived from the measure while drilling apparatus to the gap maintained with the bit in the coal seam to derive a voltage difference between electrical leads provided at the upper end of the string and in the earth at a distance from said upper end of the string.

2. The method of claim 1 wherein said electric-field borehole telemetry apparatus output is driven by a voltage source and the said monitored parameter of the electrical output of the telemetry apparatus is the output current and the said parameter used to indicate approaching or penetrating said coal boundary is the said output current.

3. The method of claim 1 wherein said electric-field borehole telemetry apparatus output is driven by a current source and the said monitored parameter of the electrical output of the telemetry apparatus is the output voltage and the said parameter used to indicate approaching or penetrating said coal boundary is the said output voltage.

4. The method of claim 1 wherein said electric-field borehole telemetry apparatus output is driven by an electric source and the said monitored parameters of the electrical output of the telemetry apparatus are the output current and output voltage and the said parameter used to indicate approaching or penetrating said coal boundary is the driving point impedance, defined as the ratio of said output voltage to said output current.

5. The method of claim 1 wherein the E-field produces a surface received signal, and driving point impedance is produced, and including the step of using said signal and impedance to determine a prospective drilling trajectory extending out of the coal seam, ahead of the drill bit, where driving point impedance is defined as the ratio of bit motor output voltage to bit motor output current.

6. The method to detect the relative position of a drill bit in a drill string with respect to a coal seam boundary using an electric-field borehole telemetry apparatus, the steps that include:

a) providing a measure-while-drilling apparatus that includes inclination sensors, directional sensors, logging sensors of choice and an electric-field telemetry borehole telemetry apparatus, associated with the bit, b) providing an insulating gap in lower end extent of the drill string, c) applying output voltage derived from the measure while drilling apparatus to the gap maintained in the coal seam to produce a voltage difference between electrical leads at the upper end of the string and in the earth at a distance from said upper end of the string, d) operating the electric-field telemetry apparatus for monitoring the inclination, direction and logging parameters, e) transmitting to the surface the inclination, direction and logging parameters, including detecting at the surface the data transmitted and monitoring the signal strength received at the surface, f) computing the usual drilling parameters needed to guide the drill string along the intended path, g) determining from the produced voltage including voltage strength received at the surface parameters indicative of bit deviation approaching or penetrating the coal boundary, and making corrections to the generally horizontal direction of drilling maintaining the gap and the terminal end of the drill string and bit, along with said insulating gap, in the coal seam, between upper and lower boundaries thereof, the gap maintained immediately behind the bit.

7. The method to detect the relative position of a drill bit with respect to a coal seam boundary using an electric-field borehole telemetry apparatus, steps that include:

a) providing a measure-while-drilling apparatus that includes inclination sensors, directional sensors, logging sensors of choice and an electric-field borehole telemetry apparatus, b) within the electric-field borehole telemetry apparatus, in addition to monitoring the inclination, direction and logging parameters, monitoring one or more parameters of the electrical output of the telemetry apparatus, c) transmitting to the surface the inclination, direction and logging parameters as well as the one or more parameters of said electrical output by means of the telemetry apparatus, d) detecting at the surface the data transmitted and monitoring the signal strength received at the surface, e) computing the usual drilling parameters needed to guide the drill string along the intended path, f) determining from the one or more transmitted parameters of the electrical output from the downhole apparatus and the signal strength received at the surface parameters indicative of bit approaching or penetrating the coal boundary, and g) making corrections to the direction of drilling to maintain the bit in the coal seam, h) the method including:

i) providing an insulating gap in lower end extent of the drill string, directly behind the drill bit thereby to maneuver the gap to travel with the bit in the coal seam, ii) applying output voltage derived from the measure while drilling apparatus to the gap maintained in the coal seam in response to bit travel to produce a voltage difference between electrical leads at the upper end of the string and in the earth at a distance from said upper end of the string.

8. The method of claim 7 wherein said electric-field borehole telemetry apparatus output is driven by a voltage source and the said monitored parameter of the electrical output of the telemetry apparatus is the output current and the said parameter used to indicate bit approaching or penetrating said coal boundary is the said output current.

9. The method of claim 7 wherein said electric-field borehole telemetry apparatus output is driven by a current source and the said monitored parameter of the electrical output of the telemetry apparatus is the output voltage and the said parameter used to indicate bit approaching or penetrating said coal boundary is the said output voltage.

10. The method of claim 7 wherein said electric-field borehole telemetry apparatus output is driven by an electric source and the said monitored parameters of the electrical output of the telemetry apparatus are the output current and output voltage and the said parameter used to indicate bit approaching or penetrating said coal boundary is the driving point impedance, defined as the ratio of said output voltage to said output current.

11. The method of any of claims 1 through 10 wherein means is provided to transmit commands from the surface to the downhole elements of said telemetry apparatus and including the additional step of transmitting downward via said means a command to the said downhole apparatus to increase the signal power or time duration so as to increase the signal-to-noise ratio of the observed parameters.

* * * * *